US006297726B1

(12) United States Patent
Yamazaki

(10) Patent No.: US 6,297,726 B1
(45) **Date of Patent: *Oct. 2, 2001**

(54) RADIO PAGING RECEIVER

(75) Inventor: Yasuyuki Yamazaki, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/047,492

(22) Filed: Mar. 25, 1998

(30) Foreign Application Priority Data

Mar. 26, 1997 (JP) ..... 9-073380

(51) Int. Cl.[7] ..... G08B 5/22

(52) U.S. Cl. ..... 340/7.2; 340/10.32; 340/5.8; 455/32.1; 455/38.1; 455/38.2

(58) Field of Search ..... 340/825.44, 825.34, 340/825.47, 5.8; 455/32.1, 38.1, 38.2

(56) References Cited

U.S. PATENT DOCUMENTS

| | | | | |
|---|---|---|---|---|
| 4,766,434 | * | 8/1988 | Matai et al. | 340/825.44 |
| 5,373,289 | * | 12/1994 | Ichinohe | 340/825.56 |
| 5,654,697 | * | 8/1997 | Uchida | 370/825.34 |
| 5,798,708 | * | 8/1998 | Katayama | 340/825.44 |
| 6,037,878 | * | 3/2000 | Yamazaki | 340/825.44 |

FOREIGN PATENT DOCUMENTS

| | | |
|---|---|---|
| 0597449 A1 | 5/1994 | (EP) . |
| 0704827 A1 | 4/1996 | (EP) . |
| 2284693 A | 6/1995 | (GB) . |
| 6-152499 | 5/1994 | (JP) . |
| 2529080 | 6/1996 | (JP) . |
| 10136419 A | 5/1998 | (JP) . |
| 9502305 A | 1/1995 | (WO) . |

* cited by examiner

*Primary Examiner*—Brian Zimmerman
*Assistant Examiner*—Yves DaLencourt
(74) *Attorney, Agent, or Firm*—McGuireWoods LLP

(57) ABSTRACT

A radio paging receiver operates in two modes. In a first mode, the pager activates light and sound alarms message regardless of who the caller is. In a second, password select mode, the pager sounds the light and sound alarms only for callers who have transmitted a password with their messages to the pager. In password select mode, the pager also allows a user to discriminate among those callers who have the password, only activating both the light and sound alarm when preselected callers are detected as transmitting a message to the pager. To make this possible, the pager uses a caller's telephone number as a password. If a message from a caller who is not selected is received, only the light alarm is activated and the message is displayed. The sound alarm is not activated. Selection of callers is made in accordance with a stored and displayed telephone directory, for example, with a stylus pen. The pager also allows caller selection to be made based on certain categories of callers or based on the time of day.

24 Claims, 11 Drawing Sheets

FIG. 11

| ADDRESS \ BIT | B7 | B6 | B5 | B4 | B3 | B2 | B1 | B0 |
|---|---|---|---|---|---|---|---|---|
| 0 | TEL024 | TEL023 | TEL022 | TEL021 | TEL014 | TEL013 | TEL012 | TEL011 |
| 1 | TEL044 | TEL043 | TEL042 | TEL041 | TEL034 | TEL033 | TEL032 | TEL031 |
| 2 | TEL064 | TEL063 | TEL062 | TEL061 | TEL054 | TEL053 | TEL052 | TEL051 |
| 3 | TEL084 | TEL083 | TEL082 | TEL081 | TEL074 | TEL073 | TEL072 | TEL071 |
| 4 | TEL104 | TEL103 | TEL102 | TEL101 | TEL094 | TEL093 | TEL092 | TEL091 |
| 5 | TEL124 | TEL123 | TEL122 | TEL121 | TEL114 | TEL113 | TEL112 | TEL111 |
| 6 | 1st CHARACTER OF NAME | | | | | | | |
| 7 | 2nd 〃 〃 | | | | | | | |
| 8 | 3rd 〃 〃 | | | | | | | |
| 9 | 4th 〃 〃 | | | | | | | |
| A | 5th 〃 〃 | | | | | | | |
| B | 6th 〃 〃 | | | | | | | |
| C | 7th 〃 〃 | | | | | | | |
| D | 8th 〃 〃 | | | | | | | |
| E | 9th 〃 〃 | | | | | | | |
| F | 10th 〃 〃 | | | | | | | |

FIG. 12

| SYNCHRONOUS DATA | ID DATA | MESSAGE DATA (INCLUDING PASSWORD DATA) |
|---|---|---|

RADIO PAGING RECEIVER

FIELD OF THE INVENTION

This invention relates to a radio paging receiver, and more particularly to a radio paging receiver with data management functions to control the calling operation of received message.

BACKGROUND OF THE INVENTION

Some conventional radio paging receivers have a function that a received message is displayed or notified only when a specific password is included in the message. For example, such a radio paging receiver is disclosed in Japanese patent application laid-open No.6-152499(1994) an titled "Radio Paging Receiver with Display".

This radio paging receiver is provided with a notification limiting means for notifying only when a predetermined specific password is included in the message. It is further provided with a time setting means which makes the notification limiting means effective at first predetermined time and makes the notification limiting means ineffective at a second predetermined time and a notifying means which notifies a notification-limited message at the second predetermined time.

In the conventional radio paging receiver, a password is previously stored in the radio paging receiver by the user, and, when a message is received during the notification control period using a password, letters included in the message are collated with the password stored in the radio paging receiver. When they are not identical with each other, the notifying operation is limited.

Meanwhile, a user may desire that the notifying operation is limited to conduct only for specific callers even when the notification control is conducted using the password. However, in the conventional radio paging receiver, such a further limitation operation is complicated and difficult to conduct.

On the other hand, the user of the radio paging receiver may change the password since the password can be freely set by the user. Unfortunately, when the message sender (caller) does not known the changed password, the message cannot be transmitted without delay.

SUMMARY OF THE INVENTION

Accordingly, it is an object o the invention to provide a radio paging receiver that the notifying operation can be easily limited to conduct only for specific callers even when the notification control is conducted using the password.

It is a further object of the invention to provide a radio paging receiver where a caller's message can be received and notified to a user without delay even when when the caller does not known the password.

According to the invention, provided is a radio paging receiver using a caller's telephone number as a password, conducting the calling control setting operation by using the password, conducting the normal calling operation by notification sound, light emission of an light-emitting element and displaying of a received message when a telephone number included in the received message coincides with the caller's telephone number as password to be stored in advance in its telephone directory function part, and prohibiting the notification sound when the telephone numbers included in the received message does not coincide with the caller's telephone number.

According to another aspect of the invention, a radio paging receiver, comprises:

means for radio-receiving a message;

means for storing in advance a paging number and a caller's telephone number used as a password;

means for displaying the message;

means for conducting an notification to call its user;

means for registering data; and a controller for conducting the calling control setting operation by using the caller's telephone number as password, conducting the calling operation by the displaying means and the notifying means when the password included in the message received by the radio-receiving means coincides with the caller's telephone number stored in the storing means, and conducting the calling operation while prohibiting only the notification of the notifying means when the password included in the message received by the radio-receiving means does not coincide with the caller's telephone number stored in the storing means.

BRIEF DESCRIPTION OF THE DRAWINGS

The invention will be explained in more detail in conjunction with the appended drawings, wherein:

FIG. 11 is a table showing an example of RAM data stored in telephone directory, and FIG. 12 is an illustration showing an example schematic signal format of received signal.

DESCRIPTION OF THE PREFERRED EMBODIMENTS

Before explaining a radio paging receiver in the preferred embodiments, the aforementioned conventional radio paging receiver will be explained in FIGS. 1 and 2.

Figure 1:
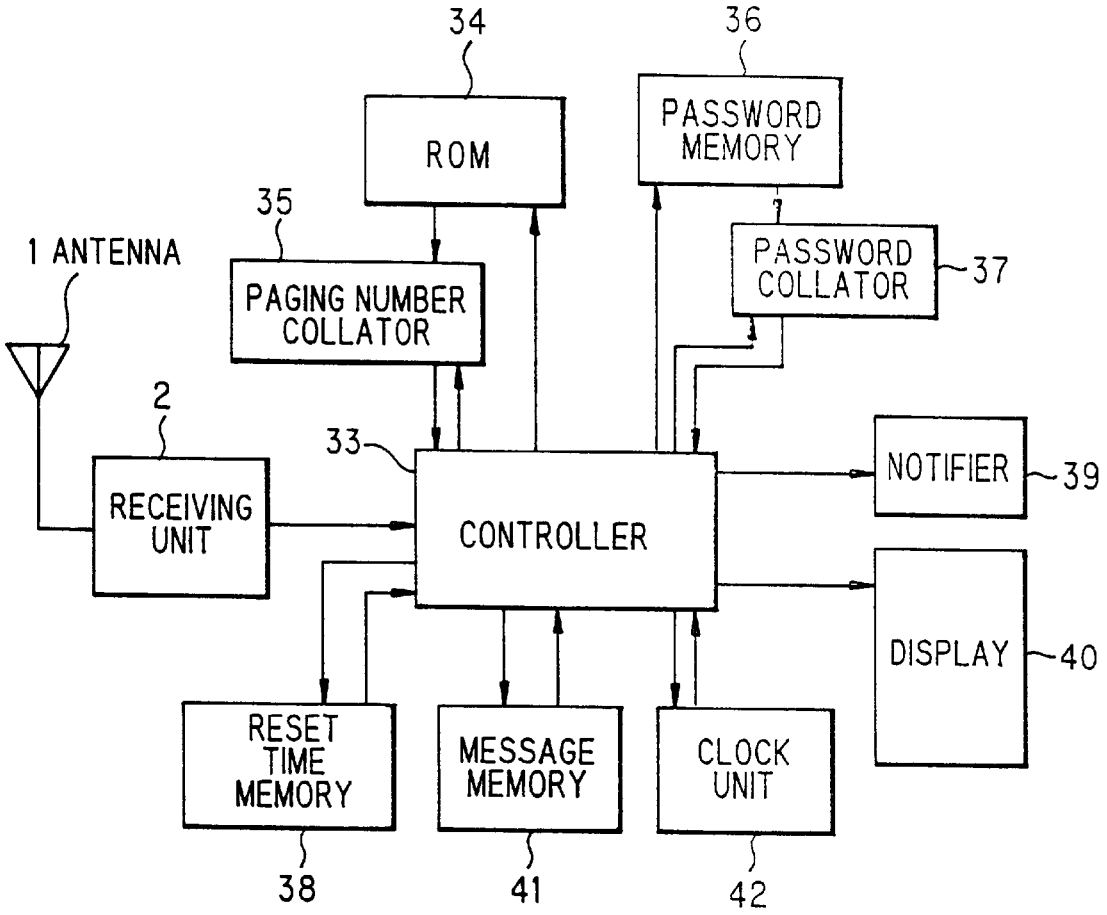
FIG. 1 PRIOR ART
FIG. 1 is a block diagram showing a conventional radio paging receiver.

FIG. 1 shows the conventional radio paging receiver. Referring to FIG. 1, the conventional radio paging receiver comprises a receiving unit 2 to demodulate radio signal received through an antenna 1, ROM 34 where a paging number is previously stored, a paging number collator 35 to collate a paging number included in the received radio signal with the paging number stored in ROM 34, a password memory 36 where a password is previously stored, a password collator 37 to collate a password included in received massage with the password stored in the password memory 36, a preset time memory 38 to store the limitation times in reception, a clock unit 42 to generate real-time signal, a message memory 41 to store received message, a notifier to generate call signal and conduct the notification, a display 40 to display the received message, and a controller 33 to manage and control all of the circuit components.

Figure 2:
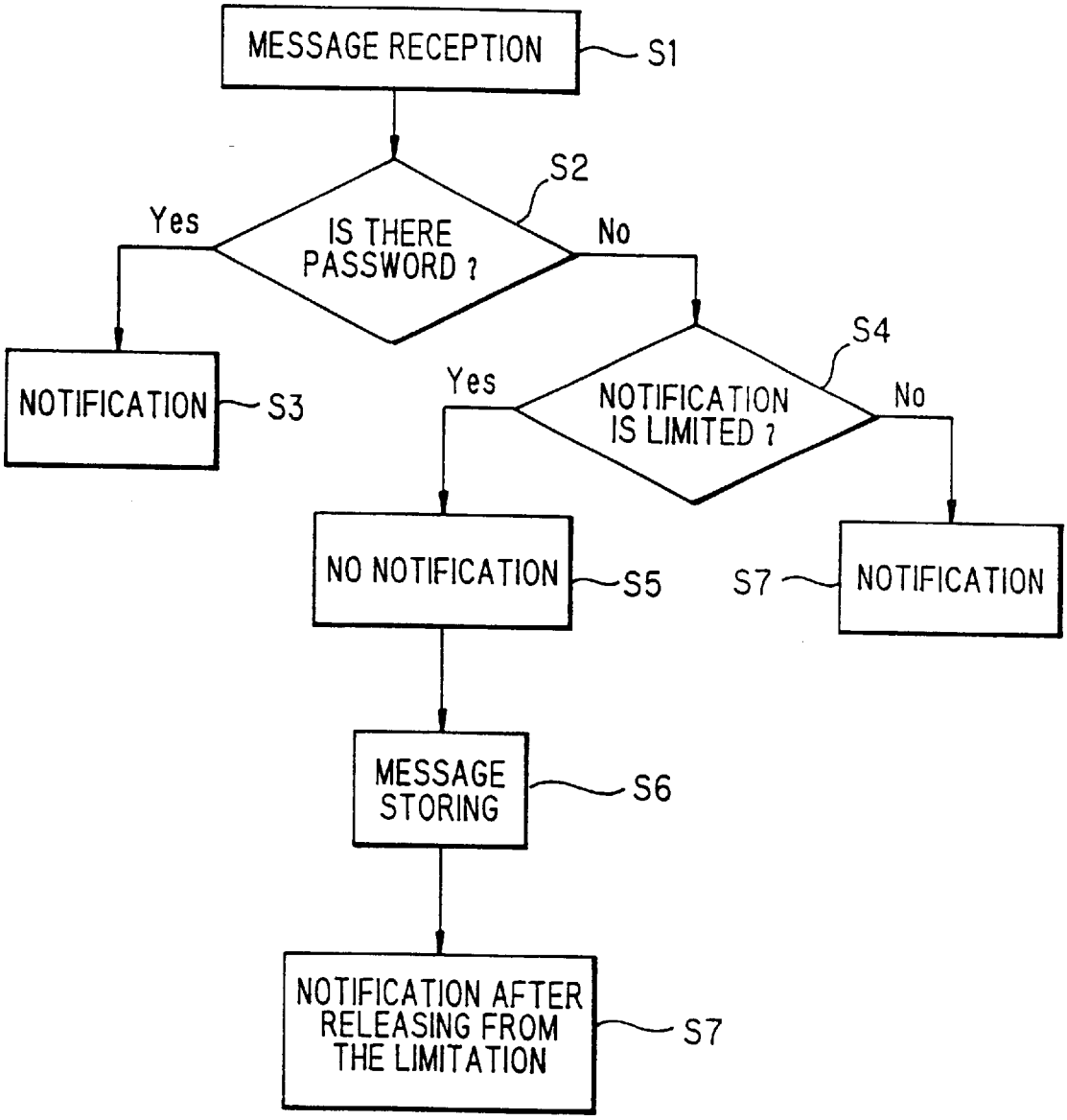
FIG. 2 PRIOR ART
FIG. 2 is a flow chart illustrating the operation of the conventional radio paging receiver.

Referring to FIG. 2, the operation of the conventional radio paging receiver will be explained.

A message is received (Step 1:S1),and then it is judged whether a password is included in the message or not (Step 2: S2), and it notifies when the password is included (Step 3: S3). When the password is not included, it is judged whether the notification is limited (Step 4: S4) or not, and it notifies when the notification is not limited (Step 7: S7). It does not notify when the notification is limited (Step 5: S5). In this case, the received message is stored (Step 6: S6), and is notified after the notification is released from the limitation (Step 7: S7).

Next, a radio paging receiver in the first preferred embodiment will be explained in FIG. 3.

The radio paging receiver in the first preferred embodiment comprises an antenna 1, a receiving unit 2 to receive radio signal from a radio station (not shown) through the antenna 1, a waveform-shaping circuit 3 to convert amplified and demodulated signal by the receiving unit 2 into data signal 24, a controller 4 to control the whole circuit, RAM 6 to store various data, ROM 7 where dictionary function data are previously stored, PROM 5 where a paging number 25 of itself is stored, an operation panel 8 for the user to input data. LCD (liquid-crystal display) 10 to display data, a drive circuit 9 to output display signal 28 to LCD 10, an amplifier 11 to amplify speaker alert signal 26, a speaker 12 to output a sound by the amplified speaker alert signal 26, an amplifier 13 to amplify LED(light-emitting diode) alert signal 29, LED 14 to emit light by the amplified LED alert signal 29, a switch 15 used to switch on or off the receiving unit 2, to stop the notifying operation and to confirm the received message, and a switch 16 for electronic memorandum function.

The controller 4 comprises an ID identifier 21 to compare the data signal 24 output from the waveform-shaping circuit 3 with its own paging number 25 stored in PROM 5, a message analyzer 22 to analyze a message from the data signal 24 output from the waveform-shaping circuit 3, a password collator 23 to collate a password included in the received message with its own password to be stored previously, and a notification commander 53 to output drive signals to LCD 10, speaker 12 and LED 14 according to the message analyzed by the message analyzer 22.

Figure 3:
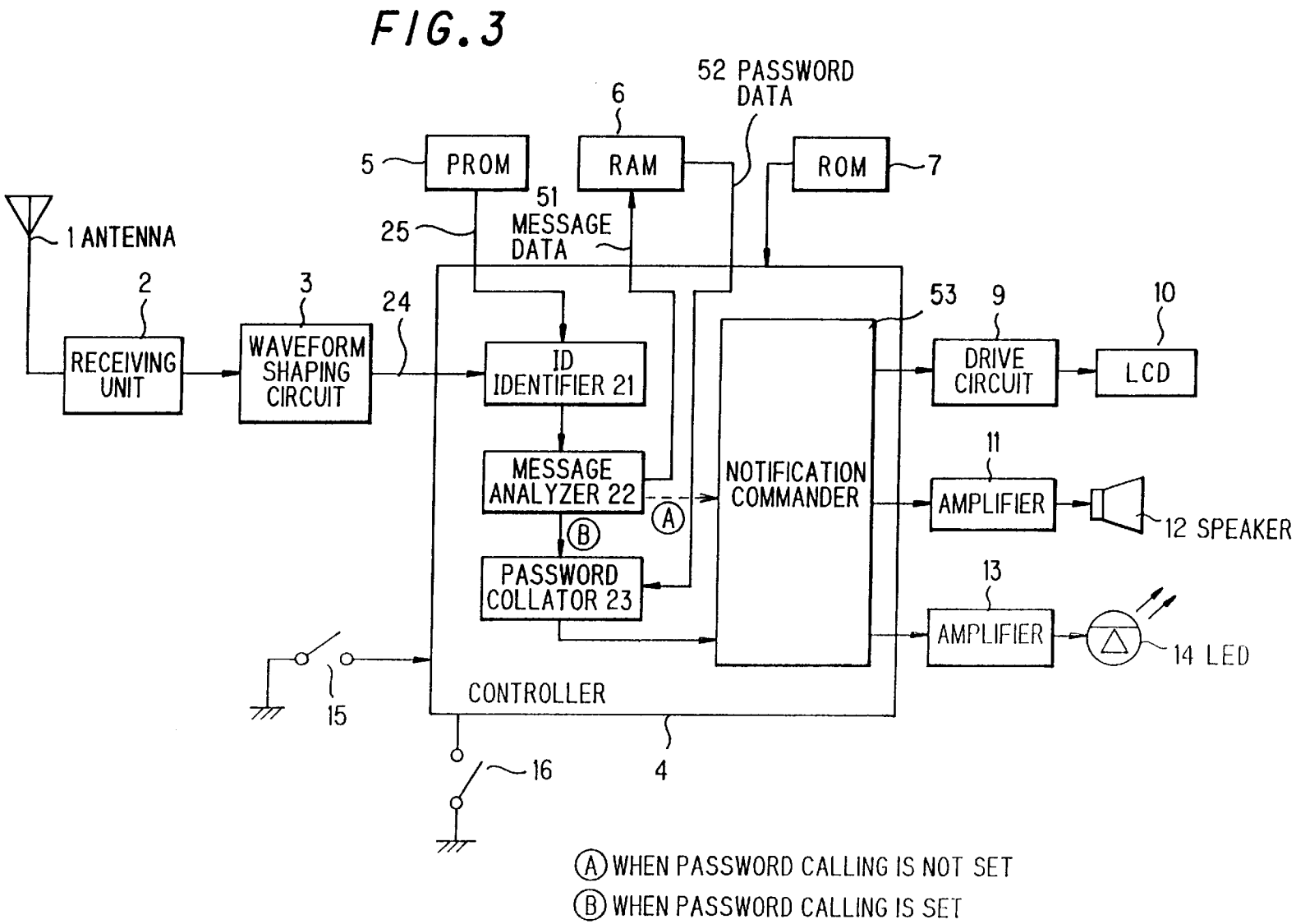
FIG. 3 is a block diagram showing a radio paging receiver in a first preferred embodiment according to the invention.

Meanwhile, in FIG. 3, like parts are indicated by like reference numerals as used in FIG. 1 and explanations thereof are omitted.

Figure 4:
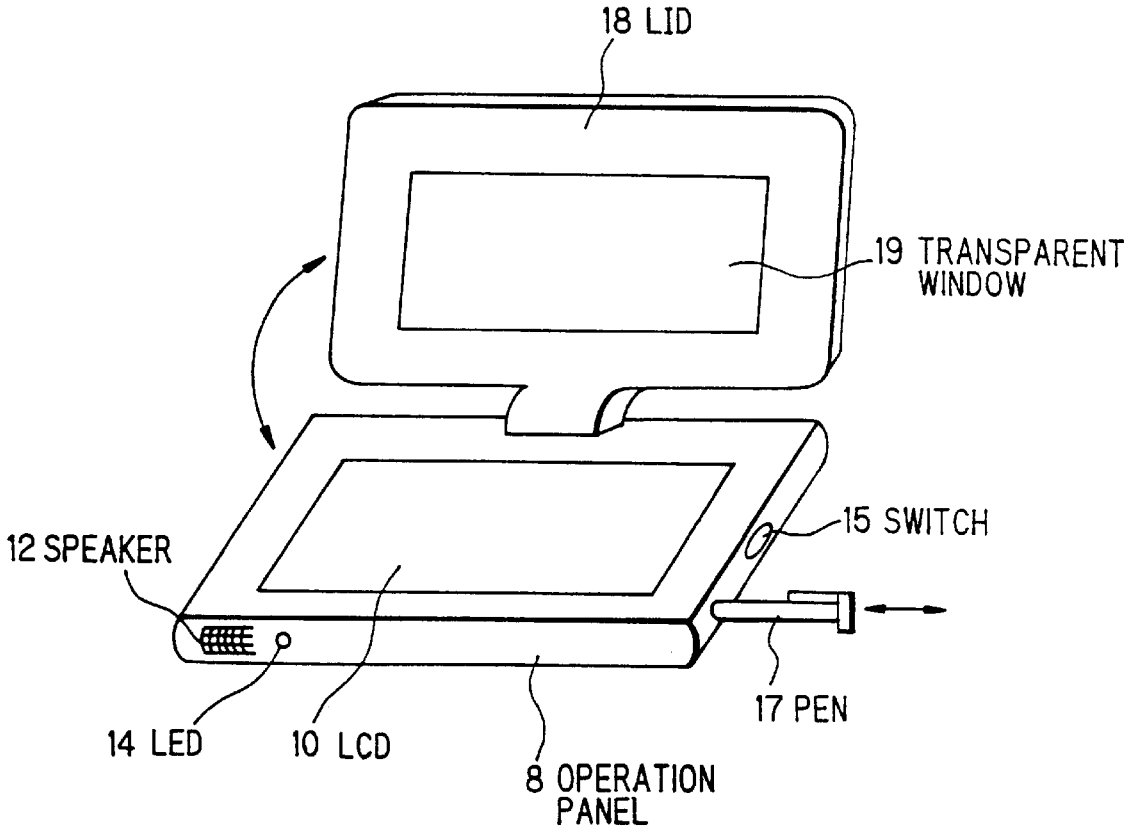
FIG. 4 is an outside view showing the radio paging receiver in the first embodiment.

FIG. 4 shows the outside view of the radio paging receiver in the first to third embodiments.

Referring to FIG. 4, the radio paging receiver is composed of an inside-protecting lid 18 capable of being hinged, and the operation panel 8. The operation panel 8 is provided with a panel-operating pen 17 capable of being inserted therein. LCD 10 to display, speaker 12, LED 14, and switch 15 which can be pushed down even when the lid 18 is shut. Further, the lid 18 is provided with a transparent window 19 disposed corresponding to LCD 10 so that the user can be see the display of LCD 10 even when the lid 18 is shut.

Next, referring to FIGS. 3 and 4, the operation of the radio paging receiver will be detailed.

The contents to be displayed on LCD 10 can be seen through the transparent window 19 even when the lid 18 is shut. Also, by using the switch 15 disposed on the right side of the operation panel 8 for switching on or of the receiving unit 2, for stopping the notifying operation and for confirming the received message, the basic operations of the radio paging receiver can be conducted even when the lid 18 is shut.

When the switch 15 is continuously pushed down, the power source of the radio paging receiver is turned on and the radio paging receiver enters into a message reception waiting state. In this state, when a message with its own paging number is received and its own password is identified, the notification (or calling) operation is carried out, i.e., LED 14 emits light, the speaker 12 outputs the speaker alert sound and LCD 10 displays the received message.

When the switch 15 is pushed down during the notification operation, the notifying of the speaker 12, LED 14 is stopped but the message displaying of LCD 10 is contained. The message can be displayed within a predetermined time period. However, when the switch 15 is pushed down during the displaying, the display of received message is turned off. Also, when the switch 15 is pushed down during the turn-off period of LCD 10, the latest one of received messages stored in RAM 6 can be displayed on LCD 10. Subsequently, when the switch 15 is pushed down during the displaying of received message, messages if present, received prior to the currently-displayed message can be displayed in the reception order. This display operation can be repeated until the oldest message stored in RAM 6 is displayed.

The controller 4 also has data management functions to data including telephone directory data and schedule data. For the operation of data management functions, the operation procedure data are displayed on LCD 10 by the controller 4. The user can conduct the function operation by touching the display position on LCD 10 corresponding to the necessary operation procedure data with the pen 17.

When a radio signal from radio station is received by the antenna 1, and is then amplified and demodulated by the receiving unit 2. For example, the radio signal received has a signal format shown in FIG. 12. The demodulated signal is waveform-shaped by the waveform-shaping circuit 3, then output as data signal 24 to the controller 4.

Then, the ID identifier 21 in the controller 4 compares a paging number to be included in the data signal 24 with its own paging number to be previously stored in PROM 5, and, when they are identical with each other, the message analyzer 22 analyzes the message of the data signal 24, then outputting the message data 51 to RAM 6 to store therein.

Then, when the password calling is not set, as shown by "A" in FIG. 3, the message analyzed by the message analyzer 22 is output to the notification commander 53. Then, the notification commander 53 outputs drive signals to LCD 10, speaker 12 and LED 14 to drive the respective devices.

On the other hand, when the password calling is set, as shown by "B" in FIG. 3, the data signal 24 is output from the message analyzer 22 to the password collator 23. Then, the password collator 23 compares the numerical data in the data signal 24 with the password data 52 from the telephone directory data stored in RAM 6. When they are identical, it is judged that the calling exits. Then, the notification commander 53 outputs alert signals 26, 29 to the amplifiers 11, 13, respectively to drive the speaker 12 and LED 14. Simultaneously, the message data 27 analyzed by the message analyzer 22 are output through the notification commander 53 to the drive circuit 9. The drive circuit 9 outputs the display signal 28 to LCD 10 to display the message data 27. When the numerical data in the data signal 24 are not identical with the password data 52, the notification commander 53 outputs drive signals only to LCD 10 and LED 14 to drive the respective devices.

The amplifier 11 amplifies the speaker alert signal 26 to sound-drive the speaker 12, thereby notifying that the calling is reached.

Also, the amplifier 13 amplifies the LED alert signal 29 output from the controller 4 to emit light from LED 14, thereby notifying that the calling is reached. The switch 15 is mainly used as the power switch of the receiving unit 12, and the switch 16 is used as the power switch of the electronic memorandum function. By separating the switch 15 from the switch 16, the functions of the radio paging receiver can be independently operated even when the electronic function is not operated.

Also, the controller 4 outputs the operation procedure data to the drive circuit 9 to display them on LCD 10. The function operation can be conducted by touching a display position on LCD 10 of the operation panel 8 corresponding to the necessary operation procedure data with the pen 17. The controller 4 stores telephone directory data to be input from the operation panel 8 or received message data into RAM 6, displaying the data again on LCD 10 according to the operation of the operation panel 8. An example of telephone directory data to be stored in RAM 6 is shown in FIG. 11. As shown, the telephone directory data are composed of a telephone number including up to 12 letters, where one letter is represented by 4 bits, and a name including up to 10 characters, where one character is represented by one byte.

In ROM 7, dictionary function data such as Chinese characters are previously stored. When the user inputs 'Kana' letters through the operation panel 8, the controller 4 reads out the converted Chinese character data as dictionary function data 30 from ROM 7. The list of converted Chinese character data are then displayed on LCD 10. and the user can select a desired character from the displayed characters and can input it as data.

Figure 5A:
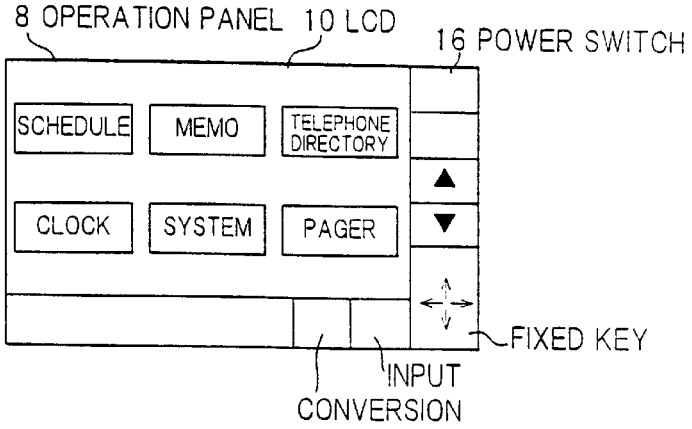
FIGS. 5A and 5B are illustrations showing LCD display operations when inputting data.
Figure 5B:
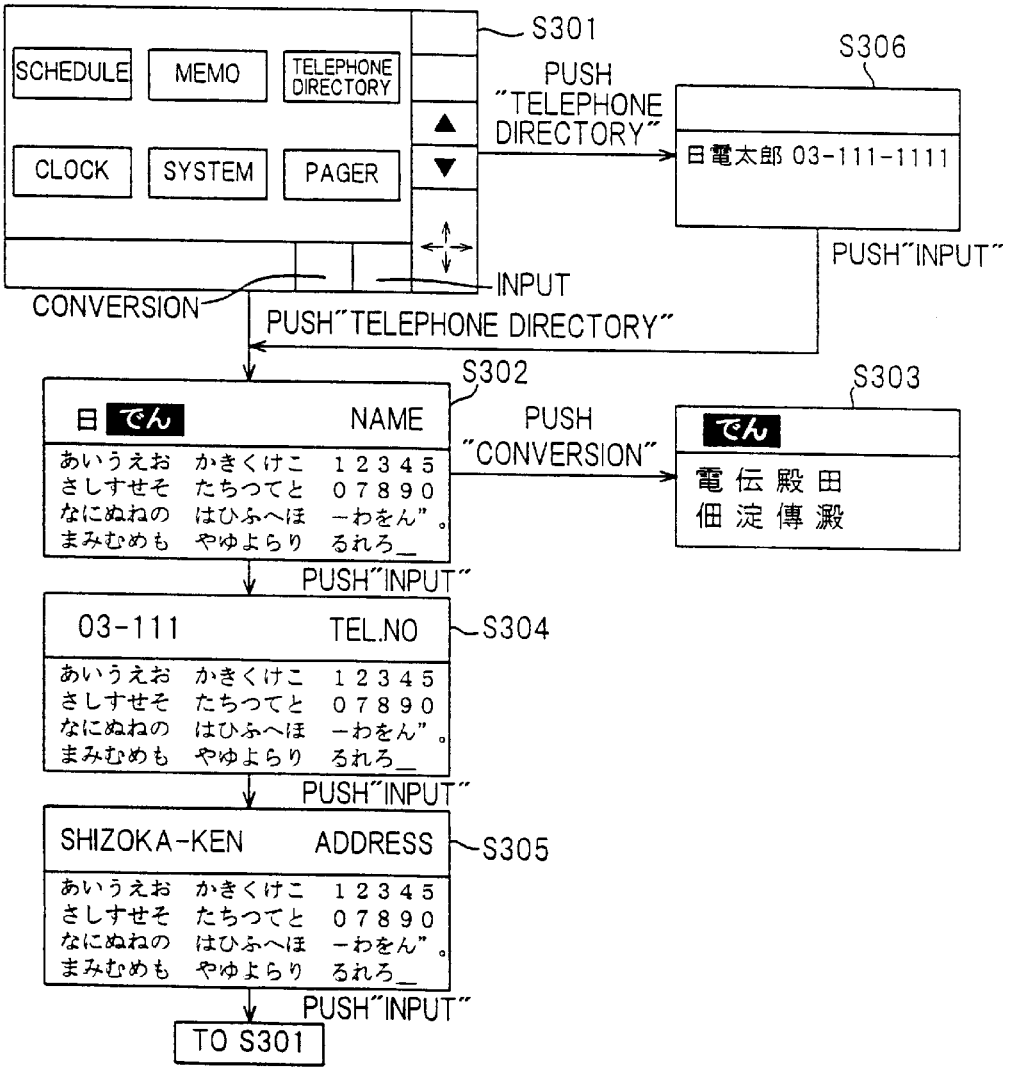

FIGS. 5A and 5B illustrate the LCD display operation when data are input. FIG. 5A shows an example of display on the operation panel 8, and FIG. 5B is a flow chart illustrating the inputting of data. Referring to FIG. 5A, there are disposed fixed key part including the switch 16 for conducting predetermined specific operations in the reverse-'L'-shaped region of the operation panel 8. Under the fixed key part, there are disposed labels to display the contents of operation. Thus, the display contents on LCD 10 can be seen on the inside region of the fixed key part of the operation panel 8.

First, when the switch 16 of the fixed key part of the operation panel 8 is touched with the pen 17 in the turn-off state of the device power, the menu image of the electronic memorandum function is displayed (Step 301: S301). When part of 'telephone directory' displayed on LCD 10 is touched with the pen 17 in case of no telephone directory data registered, the display of LCD 10 is changed into a name input image. In inputting a name, when a letter part displayed on LCD 10 is touched with the pen 17, the corresponding 'Kana' letters are first displayed being background-inverted at the upper part of LCD 10 (Step 302: S302). When the 'Kana' letters are desired to input as it is, the 'Kana' letters can be input by touching 'input' part of the fixed key part with the pen 17. Alternately, when the 'Kana' letters are desired to be converted into Chinese character, the image of LCD 10 can be changed into the list image of Chinese characters to be converted into by touching 'conversion' part of the fixed key part with the pen 17. Then, by touching part of a desired Chinese character with the pen 17, the converted Chinese character can be input (Step 303: S303).

After inputting all characters of the name, the image of LCD 10 can be changed into a telephone number input image by touching the 'input' part of the fixed key part with the pen 17. The telephone number can be input by conducting the operation like S301 to S302 (Step 304: S304). After inputting the telephone number, the image of the LCD 10 can be changed into an address input image by touching the 'input' part of the fixed key part with the pen 17. The address can be input by conducting the operation like S301 to S303 (Step 305: S305).

After inputting all data of the address, the image of LCD 10 can be returned to the menu image of the electronic memorandum function at S301 by touching the 'input' part of the fixed key part with the pen 17. Thus, the registration of data can be completed.

On the other hand, in case of having telephone directory data already registered at S301, when part of 'telephone directory' displayed on LCD 10 is touched with the pen 17, the registered data of the telephone directory are displayed (Step 306: S306). Here, when new data are desired to input, the display of LCD 10 can be changed into the name input image at S302 by touching the 'input' part of the fixed key part with the pen 17. The inputting of data can be conducted by repeating the above operations.

Figure 6:
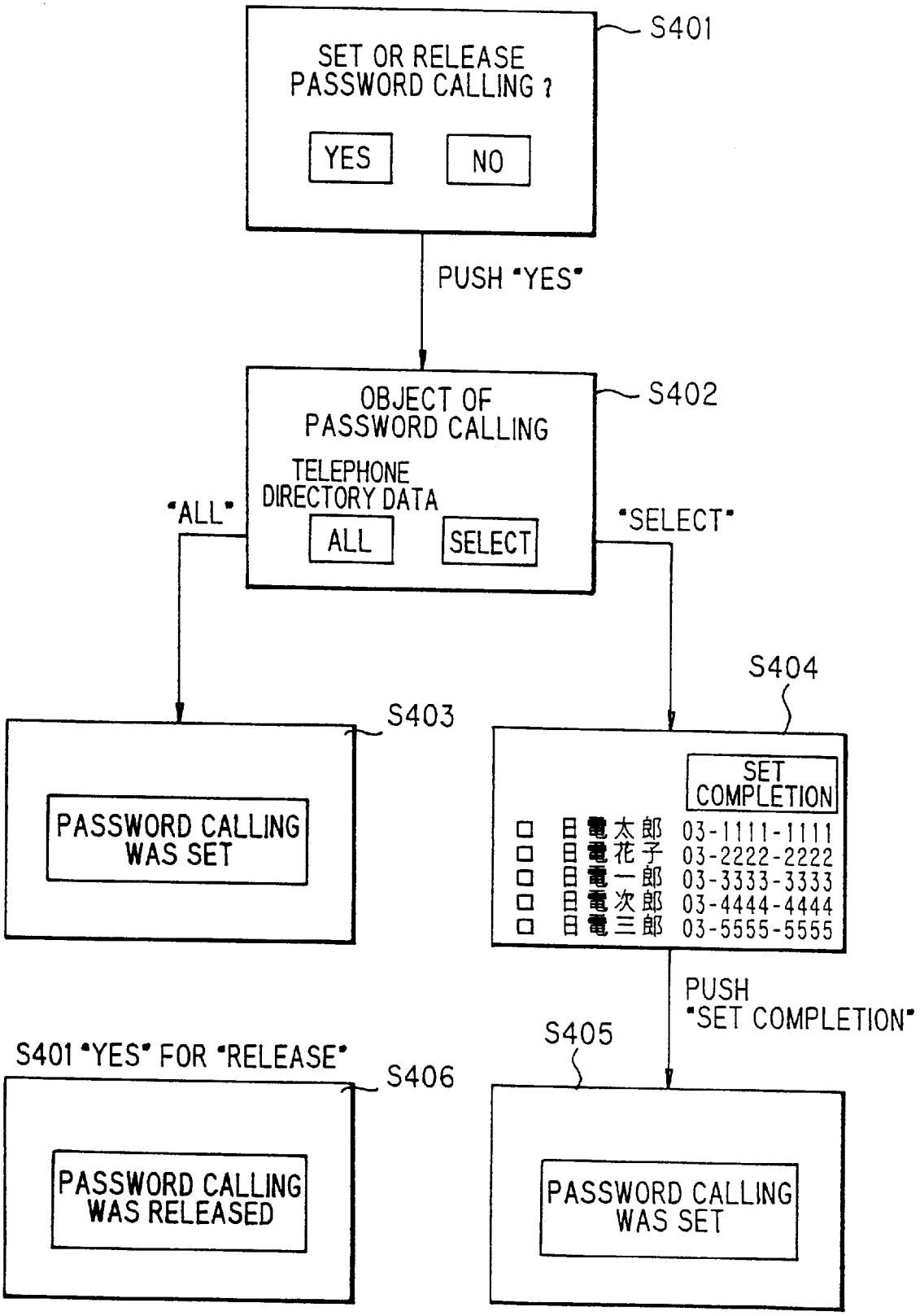
FIG. 6 is an illustration showing LCD display operations when setting some functions.

FIG. 6 illustrates the LCD display operation when the password calling function is set.

Referring to FIG. 6, when the user selects the setting mode for the password calling control function by touching part of 'system' on LCD 10 of the operation panel 8, the setting or releasing of password calling can be displayed (Step 401: S401). At S401, by touching part of 'NO' on LCD 10, the setting mode can be canceled, then returned to the menu image in FIG. 5A.

By touching part of 'YES' on LCD 10 with the pen 17 at S401, the selection image of objects of password calling is displayed (Step 402: S402). Namely, the user can select either of that the objects of password calling for conducting the normal calling operation when receiving a message are all of telephone number data registered in the telephone directory or that a specific person needs to be selected from the telephone directory.

Thus, the user can select all of the telephone number data registered in the telephone directory by touching part of 'all' on LCD 10 with the pen 17, thereby completing the setting of the password calling function (Step 403: S403).

Alternatively, when the user wants to select a specific person from the telephone directory, the telephone directory data can be displayed by touching part of 'select' on LCD 10 with the pen 17 (Step 404: S404). by selecting a person, for the person, the normal calling operation when receiving a message can be conducted even when the password calling control function is set. By touching part of 'set completion' on LCD 10 with the pen 17, the setting can be completed (Step 405: S405).

On the other hand, when the user wants to release the currently-operated password calling control function, the user selects the setting mode for the password calling control function by touching the part of 'system' on LCD 10 of the operation panel 8. In this case, the message of "release password calling ?" can be displayed on LCD 10 (S401). Then, the password calling can be released by selecting 'YES' (Step 406: S406). When selecting 'NO', the releasing mode is cancelled, then returned to the menu image in FIG. 5A.

Figure 7:
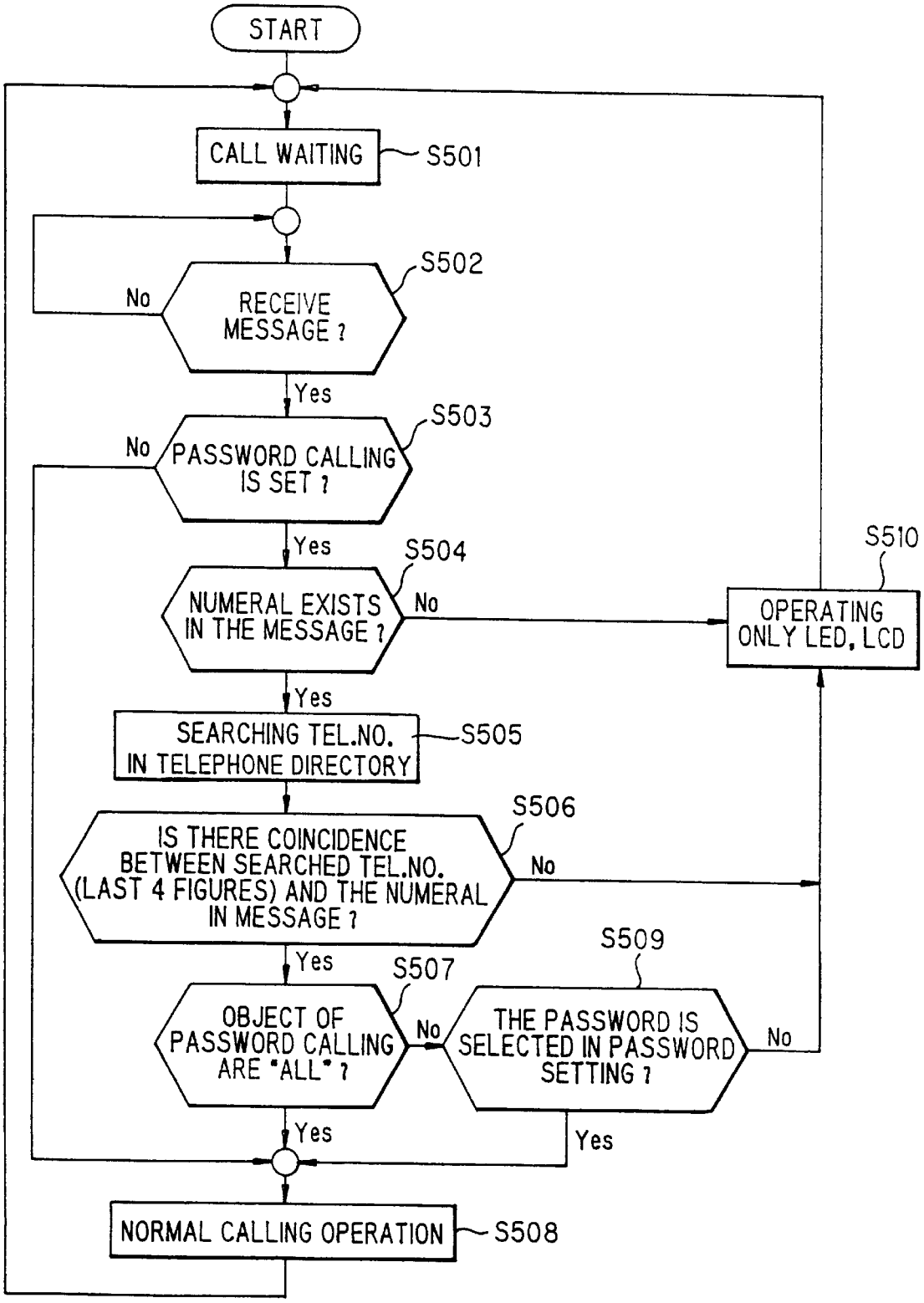
FIG. 7 is a flow chart illustrating the operation of the radio paging receiver in the first embodiment.

FIG. 7 is a flow chart illustrating the operation of the radio paging receiver in the first embodiment. Referring to FIG. 7, the operation of password calling control function will be explained below.

When the power source of the radio paging receiver is turned on by the switch 15, it enters into the reception waiting state (Step 501: S501). Then, it continuously waits the reception of message at Step 502 (S502). The controller 4 confirms whether the password calling control function is set or not (Step 503: S503). When the password calling control function is not set, it proceeds into Step 508 (S508), conducting the normal calling operation to notify the user of the calling by driving the alert sound of the speaker 12, the light emission of LED 14 and the display of received message on LCD 10.

On the other hand, when the password calling control function is set at S503, it is judged whether the message data received include numerical data (Step 504: S504). When the message data include numerical data, such as "Please call me 1234" and "Please call me *.*.1234", the controller 4 searches the last 4 figures of numerical data, such as '1234', from the telephone number data of the telephone directory stored in RAM 6 (Step 505: S505).

At Step 506 (S506), the password collator 23 of the controller 4 judges whether the same data exists or not. When the same data exists, it proceeds into Step 507 (S507). When the objects of password calling 'all' are selected in case of setting the password calling control function, it proceeds into S508, conducting the normal calling operation to notify the user of the calling by driving the alert sound of the speaker 12, the light emission of LED 14 and the display of received message on LCD 10. When 'select' is selected at S507, it proceeds into Step 509 (S509), then proceeding into S508 when it is judged that the telephone number is selected by the user, thereby conducting the normal calling operation to notify the user of the calling by driving the alert sound of the speaker 12, the light emission of LED 14 and the display of received message on LCD 10.

When it is judged that the telephone number is not selected by the user at S509, or when the last 4 figures searched are not identical with the numerical data in the received message data at S506, or when no numerical data is not included, e.g., "I'll be late", it proceeds into Step 510 (S510), conducting the calling operation by only the light emission of LED 14 and the display of received message on LCD 10, further storing the received message into RAM 6 so that it can be confirmed thereafter. After conducting the calling operations at S508 and S510, it returns to S501, entering again into the reception waiting state. Thus, the password calling control function can be repeated until it is released.

Figures 8A, 8B:
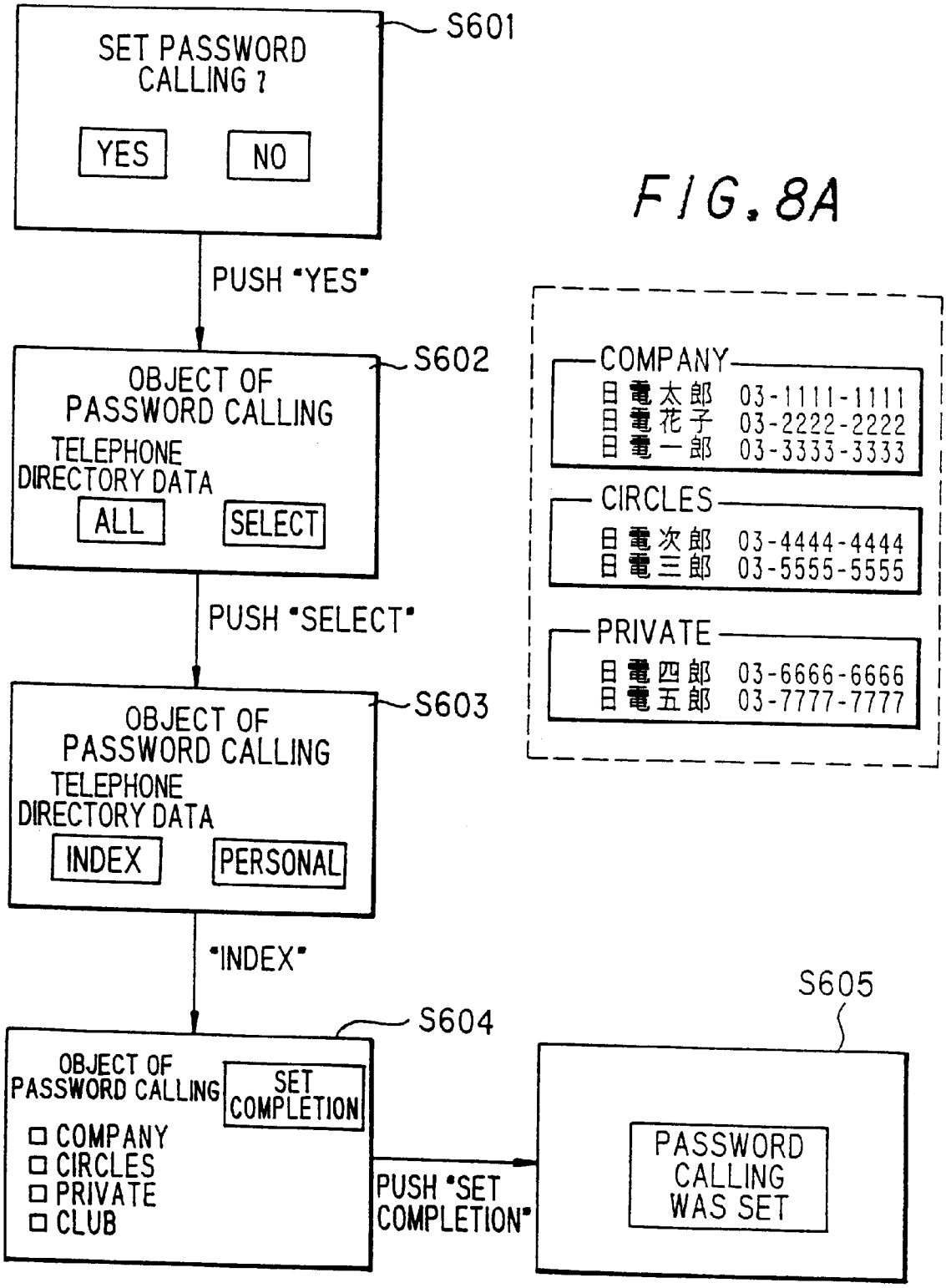
FIGS. 8A and 8B are illustrations showing LCD display operations of a radio paging receiver in a second preferred embodiment according to the invention.

FIGS. 8A and 8B illustrate the LCD displaying of a radio paging receiver in the second preferred embodiment. FIG. 8A shows an example of data group in telephone directory. FIG. 8B is a flow chart showing operations to set the password calling control function.

As shown in FIG. 8A, data are, as a kind of telephone directory function, classified into 'company', 'circles' and 'private'.

Referring to FIG. 8B, to set the password calling control function, 'YES' is touched at Step 601 (S601),thereby proceeding to Step 602 (S602). When 'NO' is touched at S601, the password calling control function is cancelled, then returning to the menu image. At S602, when 'select' is touched to select the objects of password calling from the telephone directory data, it proceeds to Step 603 (S603). At S603, it is displayed on CLD 10 to choose the objects of password calling by which of 'personal' and 'index'. When 'index' is chosen, the index data of the telephone directory are displayed on LCD 10 (Step 604: S604). Here, when an index is selected, persons registered in this index are called by the alert sound of the speaker 12 even when the password calling control function is effective. For example, when 'company' is selected, the telephone numbers of all persons in the index 'company' shows in FIG. 8A can be passwords. Then, by touching part of 'set completion', the password calling control is started (Step 605: S605).

As described above, in the second embodiment, the user does not have to select one by one the objects of the password calling as a specific group classified by the user can be chosen by using the index. Thus, the setting of the password calling is easy to conduct.

Figure 9:
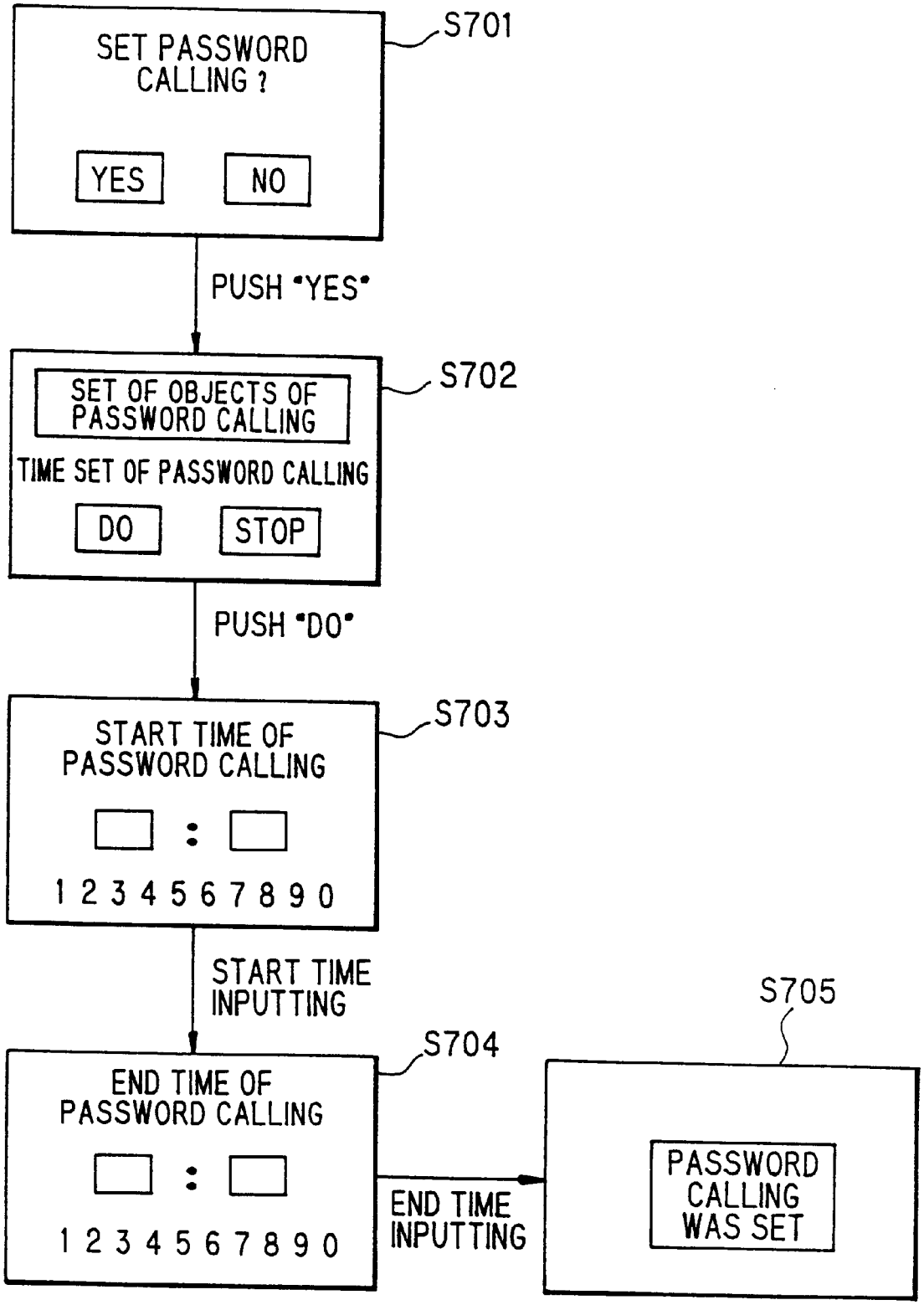
FIG. 9 is an illustration showing LCD display operations of a radio paging receiver in a third preferred embodiment according to the invention.

FIG. 9 illustrates the LCD displaying of a radio paging receiver in the third preferred embodiment.

In the third embodiment, the controller 4 has a clock function that times for starting and ending the password calling control can be set when setting the password calling control function. In this case, when it comes to the start time after setting the password calling control function, the calling by the speaker alert sound is automatically conducted to only the message of the preset password caller. When it comes to the end time, the password calling control function is automatically ended.

Referring to FIG. 9, to set the password calling control function, 'YES' is touched at Step 701 (S701), thereby proceeding to Step 702 (S702). When 'NO' is touched at S701, the password calling control function is cancelled, then returning to the menu image. At S702, 'set of objects of password calling' and whether to 'do' the time set of password calling or 'stop' it are displayed on LCD 10. Here, the previously-set password caller can be changed by touching part of 'set of objects of password calling', whereby it proceeds to S402 shown in FIG. 6 and then the operations described with reference to FIG. 6 can be conducted to change the password caller setting. This change operation can be also conducted after completing the operation 'time set of password calling'.

Next, when 'do' is touched in the time set of password calling, it proceeds to an image for inputting the start time of password calling Step 703 (S703). At S703, by touching numbers displayed at the bottom of LCD 10, time corresponding to the touched numbers can be input in part of '□:□'. After completing the inputting of the start time, it proceeds to an image for inputting the end time of password calling Step 704 (S704). In the same manner as the start time, the end time can be input. Then, the setting of the password calling control function is completed (Step 705: S705).

In the third embodiment, the password calling control can be conducted only during the preset time every day. When the password callers do not need to be changed, the start and release of the password calling control can be automatically conducted by setting them only once at the first time. Thus, it is not needed to set them every day. Further, it can prevent the release of the password calling control from being forgotten.

Figure 10:
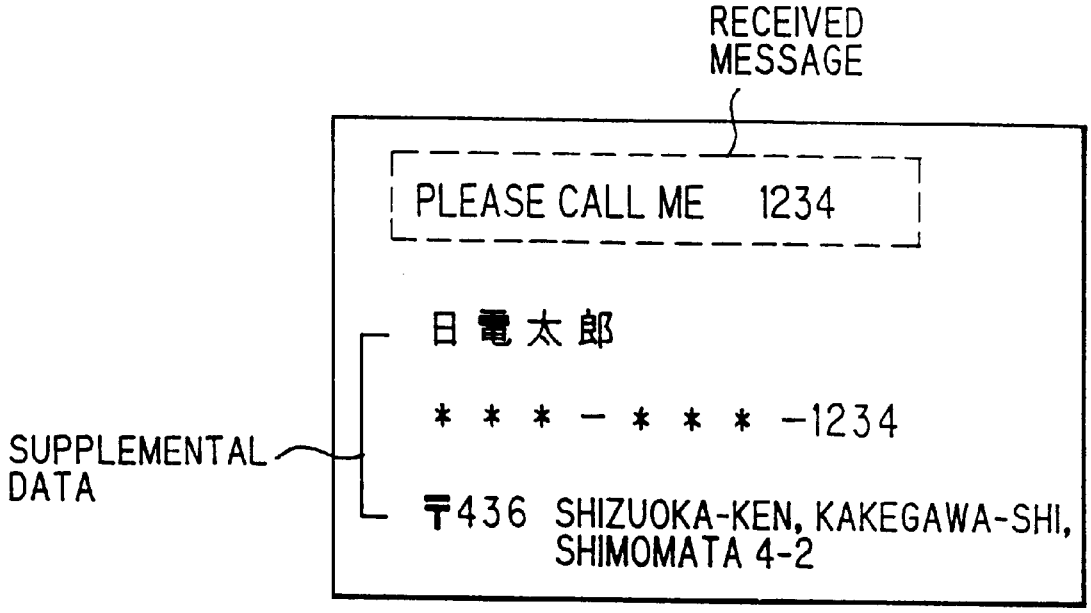
FIG. 10 is an illustration showing LCD display of a radio paging receiver in a fourth preferred embodiment according to the invention.

FIG. 10 illustrates the LCD displaying of a radio paging receiver in the fourth preferred embodiment.

In the fourth embodiment, the user can, in advance, ask a caller to send message data including his own telephone number. When a received message includes numerical data to indicate a telephone number, such as 'Please call me 1234', the controller 4 searches the last 4 figures of numerical data, such as '1234', from the telephone number data of the telephone directory stored in RAM 6 regardless of the setting state of password calling control function. When the same data exists, supplemental data, such as name data in the telephone directory are displayed with the message data. The supplemental data may include name, telephone number and address, but are not limited to them. Thus, the user to hold the receiver can easily identify the sender of the message data, while he cannot know who sends the message data to him by only the message data.

In the above embodiments, to use the telephone numbers in the telephone directory as the password for calling operation control can prevent the message sender from forgetting the password since the password of the radio paging receiver can be his own telephone number.

Also, the radio paging receivers in above embodiments have the function that a specific person desired to conduct the calling operation even when the password calling control function is set can be selected from the telephone directory data. Thereby, the calling operation can be conducted to only the message of a specific person selected from the persons registered in the telephone directory, and, to the other persons, only the light emission of LED and LCD display are conducted when receiving their messages. Thus, the user of the radio paging receiver can be substantially released from changing the password.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. A radio paging receiver, comprising:

means for conducting a calling control setting operation based on a password which corresponds to a telephone number of a caller;

means for conducting a normal calling operation by notification sound, light emission of a light-emitting element;

means for displaying a received message when a telephone number included in said received message coincides with said caller's telephone number which was stored and selected as said password in advance in a telephone directory function part of said receiver; and means for prohibiting said notification sound when said telephone number included in said received message does not coincide with said caller's telephone number.

2. A radio paging receiver according to claim 1, further comprising:

means for conducting a calling operation by only light emission of said light-emitting element and displaying of said received message when said telephone number included in said received message does not coincide with said caller's telephone number; and means for storing said received message in a memory part of said paging receiver so that it can be confirmed thereafter.

3. A radio paging receiver according to claim 1, wherein said means for conducting the calling control setting operation allows a user to select said telephone number from telephone number data stored in a telephone directory function part of said paging receiver even when a calling control operation is set based on said password;

wherein said means for conducting the normal calling operation conducts said normal calling operation only when a message includes said selected telephone number;

wherein said pager receiver includes means for conducting a calling operation limited to only light emission of said light-emitting element and display of said received message when receiving a message not including said selected telephone number; and wherein said pager receiver includes means for storing said received message in a memory part of said pager receiver so that said received message can be confirmed thereafter.

4. A radio paging receiver, comprising:

means for radio-receiving a message;

means for storing in advance a paging number and a caller's telephone number used as a password;

means for displaying said message;

means for conducting a notification to call a user;

means for registering data; and a controller for conducting a calling control setting operation using said caller's telephone number as a password, conducting a calling operation by said displaying means and said notifying means when said password included in said message received by said radio-receiving means coincides with said caller's telephone number stored in said storing means, and conducting the calling operation while prohibiting only the notification of said notifying means when said password included in said message received by said radio-receiving means does not coincide with said caller's telephone number stored in said storing means.

5. A radio paging receiver, according to claim 4, wherein:

said controller selects a specific telephone number to conduct the calling operation from telephone number data stored in said storing means, conducting the calling operation by said displaying means and said notifying means only when receiving a message including said selected specific telephone number, conducting the calling operation while prohibiting only the notification of said notifying means when said password included in said message received by said radio-receiving means does not coincide with said selected specific telephone number.

6. A radio paging receiver, according to claim 4, wherein:

said controller has a clock function that a calling start time and a calling end time are registered when setting the calling control operation by using said password, starting the calling operation by using said password at said calling start time, ending the calling operation by using said password at said calling end time and then returning to the normal calling operation.

7. A radio paging receiver, according to claim 5, wherein:

said controller has a clock function that a calling start time and a calling end time are registered when setting the calling control operation by using said password, starting the calling operation by using said password at said calling start time, ending the calling operation by using said password at said calling end time and then returning to the normal calling operation.

8. A radio paging receiver, according to claim 4, wherein:

said displaying means displays said message data with supplemental data such as name, telephone number and address to be read out from said storing means according to the password included in said message data.

9. A radio paging receiver, according to claim 5, wherein:

said displaying means displays said message data with supplemental data such as name, telephone number and address to be read cut from said storing means according to the password included is said message data.

10. A radio paging receiver, according to claim 6, wherein:

said displaying means displays said message data with supplemental data such as name, telephone number and address to be read out from said storing means according to the password included in said message data.

11. A radio paging receiver, according to claim 7, wherein:

said displaying means displays said message data with supplemental data such as name, telephone number and address to be read out from said storing means according to the password included in said message data.

12. A pager, comprising:

a notification circuit;

a receiving which receives a paging signal;

a memory which stores a plurality of passwords;

a selector which allows a user to select a subset of said passwords;

a means for locating a password in said paging signal;

a password collator which compares the password in said paging signal to the subset of said passwords selected by said selector; and a controller which activates said notification circuit when said password collator determines that the password in said paging signal matches one of said subset of passwords selected by said selector, and which does not activate said notification circuit when said password collator determines that the password in said paging signal does not match one of said subset of passwords selected by said selector.

13. A pager according to claim 12, wherein said plurality of passwords and the password in said paging signal are telephone numbers.

14. A pager according to claim 13, wherein said password collator compares a portion of said telephone number in said paging signal with corresponding portions of the telephone numbers in said subset of passwords selected by said selector.

15. A pager according to claim 12, wherein said notification circuit is an audible alarm.

16. A pager according to claim 15, further comprising:

a light alarm; and a display for displaying information within said paging signal;

wherein said controller activates said light alarm and outputs a message within said paging signal to said display when said password collator determines that the password in said paging signal does not match one of said subset o passwords selected by said selector.

17. A pager according to claim 12, further comprising:

a switch which places said pager in either a password calling mode or a non-password calling mode.

18. A pager according to claim 12, wherein said selector is one of a switch or an arrangement which includes a hand-held stylus used to make menu selections on a display of said pager.

19. A pager according to claim 12, further comprising:

a display;

a lid which closes over said display, said lid having a transparent window which allows a user to see a displayed message derived from said paging signal when said lid is in a closed position.

20. A pager according to claim 12, further comprising:

a display;

a stylus attached to a housing of said pager; and a memory which stores a personal scheduler program, said display displaying a menu generated by said personal scheduler program;

wherein said stylus is used by a user to make menu selections for operating said personal scheduler program.

21. A pager according to claim 20, wherein said personal scheduler program operates when power is turned off to a message-receiving portion of said pager.

22. A pager according to claim 20, wherein said personal scheduler program includes an electronic memorandum function.

23. A pager according to claim 12, wherein said memory stores said plurality of telephone numbers into at least two categories, and wherein the subset of said passwords selected by said selector corresponds to passwords in one of said categories.

24. A pager according to claim 12, further comprising:

a means for placing said pager in either a password calling mode or a non-password calling node; and a means for allowing a user to set a time of day when said password calling mode is selected.

* * * * *